United States Patent [19]

Chang et al.

[11] Patent Number: 4,676,829

[45] Date of Patent: Jun. 30, 1987

[54] COLD WORKED TRI-NICKEL ALUMINIDE ALLOY COMPOSITIONS

[75] Inventors: Keh-Minn Chang; Alan I. Taub, both of Schenectady; Shyh-Chin Huang, Latham, all of N.Y.

[73] Assignee: General Electric Company, Schenectady, N.Y.

[21] Appl. No.: 783,723

[22] Filed: Oct. 3, 1985

[51] Int. Cl.[4] ..... C22C 29/14

[52] U.S. Cl. ..... 75/246; 75/0.5 C; 75/82; 75/244; 75/251; 148/11.5 A; 148/11.5 N; 148/11.5 P; 148/126.1; 148/162; 148/409; 148/429; 419/23; 419/30; 419/31; 419/46; 419/49; 419/62; 419/66; 419/68; 420/460; 420/590

[58] Field of Search ..... 75/0.5 C, 82, 129, 244, 75/246, 257; 148/162, 126.1, 409, 429, 11.5 A, 11.5 N, 11.5 P; 420/460, 590; 419/23, 30, 25, 31, 49, 46, 68, 62, 66

[56] References Cited

U.S. PATENT DOCUMENTS

| | | | |
|---|---|---|---|
| 2,755,184 | 7/1956 | Turner et al. | 420/460 |
| 3,653,976 | 4/1972 | Miller et al. | 420/460 |
| 3,902,900 | 9/1975 | Restall et al. | 420/449 |
| 3,922,168 | 11/1975 | Restall et al. | 420/448 |
| 4,379,720 | 4/1983 | Ray et al. | 420/460 |
| 4,478,791 | 10/1984 | Haung et al. | 420/449 |

OTHER PUBLICATIONS

C. T. Liu & C. C. Koch, "Development of Ductile Polycrystalline $Ni_3Al$ for High-Temperature Applications", Technical Aspects of Critical Materials Use by the Steel Industry, NBSIR 83-2679-2, vol. IIB (Jun. 1983) Center for Materials Science, U.S. Dept. of Commerce, Nat'l. Bureau of Standards.

*Primary Examiner*—Stephen J. Lechert, Jr.
*Attorney, Agent, or Firm*—Paul E. Rochford; James C. Davis, Jr.; Paul R. Webb, II

[57] ABSTRACT

Improvements in the positive temperature dependence of yield strength and in the work hardening rate of tri-nickel aluminide base alloys are achieved. The novel alloy composition has seven alloying ingredients as follows:

| Ingredient | Concentration in Atomic % |
|---|---|
| Ni | balance |
| Co | 8–12 |
| Al | 16–20 |
| Si | 4–6 |
| Nb | 0.26–0.30 |
| Zr | 0.02–0.04 |
| B | 0.2–0.7 |

The novel composition may be prepared by forming a melt of the composition and atomizing the melt with an inert gas to form fine particles with $L1_2$ type crystal structure. The powder is densified by heat and pressure to a novel alloy composition having the improvements in positive temperature dependence of yield strength and work hardening rate as noted above.

20 Claims, 3 Drawing Figures

COLD WORKED TRI-NICKEL ALUMINIDE ALLOY COMPOSITIONS

BACKGROUND OF THE INVENTION

The present invention relates generally to alloy compositions having a tri-nickel aluminide base. More specifically, it relates to rapidly solidified tri-nickel aluminide base materials which include quantities of strengthening and ductilizing additives and which may be processed into useful articles. Also it relates to rapidly solidified tri-nickel aluminide base alloy which has improved properties based on a combination of doping and alloying and working.

It is known that polycrystalline tri-nickel aluminide castings exhibit properties of extreme brittleness, low strength and poor ductility at room temperature.

The single crystal tri-nickel aluminide in certain orientations does display a favorable combination of properties at room temperature including significant ductility. However, the polycrystalline material which is conventionally formed by known processes does not display the desirable properties of the single crystal material and, although potentially useful as a high temperature structural material, has not found extensive use in this application because of the poor properties of the material at room temperature.

It is known that nickel aluminide has good physical properties at temperatures above 1000° F. and could be employed, for example, in jet engines as component parts at operating or higher temperatures. However, if the material does not have favorable properties at room temperature and below the part formed of the aluminide may break when subjected to stress at the lower temperatures at which the part would be maintained prior to starting the engine and prior to operating the engine at the higher temperatures.

Alloys having a tri-nickel aluminide base are among the group of alloys known as heat-resisting alloys or superalloys. These alloys are intended for very high temperature service where relatively high stresses such as tensile, thermal, vibratory and shock are encountered and where oxidation resistance is frequently required.

Accordingly, what has been sought in the field of superalloys is an alloy composition which displays favorable stress resistant properties not only at the elevated temperatures at which it may be used, as for example in a jet engine, but also a practical and desirable and useful set of properties at the lower temperatures to which the engine is subjected in storage and mounting and starting operations. For example, it is well known that an engine may be subjected to subfreezing temperatures while standing on an airfield or runway prior to starting the engine.

Significant efforts have been made toward producing a tri-nickel aluminide and similar superalloys which may be useful over such a wide range of temperature and adapted to withstand the stress to which the articles made from the material may be subjected in normal operations over such a wide range of temperatures.

For example, U.S. Pat. No. 4,478,791, assigned to the same assignee as the subject application, teaches a method by which a significant measure of ductility can be imparted to a tri-nickel aluminide base metal at room temperature to overcome the brittleness of this material.

Also, copending applications of the same inventors as the subject application, Ser. Nos. 647,326; 647,327; 647,328; 646,877 and 646,879 filed Sept. 4, 1984 teach methods by which the composition and methods of U.S. Pat. No. 4,478,791 may be further improved. These applications and this patent are incorporated herein by reference.

For the unmodified binary intermetallic, there are many reports in the literature of a strong dependence of strength and hardness on compositional deviations from stoichiometry. E.M. Grala in "Mechanical Properties of Intermetallic Compounds", Ed. J.H. Westbrook, John Wiley, New York (1960) p. 358, found a significant improvement in the room temperature yield and tensile strength in going from the stoichiometric compound to an aluminum-rich alloy. Using hot hardness testing on a wider range of aluminum compositions, Guard and Westbrook found that at low homologous temperatures, the hardness reached a minimum near the stoichiometric composition, while at high homologous temperature the hardness peaked at the 3:1 Ni:Al ratio. Trans. TMS-AIME 215 (1959) 807. Compression tests conducted by Lopez and Hancock confirmed these trends and also showed that the effect is much stronger for Al-rich deviations than for Ni-rich deviations from stoichiometry. Phys. Stat. Sol. A2 (1970) 469. A review by Rawlings and Staton-Bevan concluded that in comparison with Ni-rich stoichiometric deviations, Al-rich deviations increase not only the ambient temperature flow stress to a greater extent, but also that the yield stress-temperature gradient is greater. J. Mat. Sci. 10 (1975) 505. Extensive studies by Aoki and Izumi report similar trends. Phys. Stat. Sol. A32 (1975) 657 and Phys. Stat. Sol. A38 (1976) 587. Similar studies by Noguchi, Oya and Suzuka also reported similar trends. Met. Trans. 12A (1981) 1647.

More recently, an article by C.T. Liu, C.L. White, C.C. Koch and E.H. Lee appearing in the "Proceedings of the Electrochemical Society on High Temperature Materials", ed. Marvin Cubicciotti, Vol. 83-7, Electrochemical Society, Inc. (1983) p. 32, discloses that the boron induced ductilization of the same alloy system is successful only for aluminum lean $Ni_3Al$.

The tri-nickel aluminide alloys known in the prior art display a positive strength relationship to temperature. That is the strength of these aluminides increases as the temperature is increased. Such prior art alloys are known to be stronger at 600° C. than they are at room temperature. What is desirable and is sought in relation to such alloys is a more rapid increase in strength with increasing temperature.

Also it is known that a ductile tri-nickel aluminide will undergo a moderate degree of work hardening. For example if a specimen of a boron doped and moderately ductile tri-nickel aluminide is rolled to reduce its thickness by about 10% the specimen is made harder by this rolling. What is known to be desirable and to be sought in relation to such aluminides is a composition which will undergo greater hardening for a given extent of working, as for example a 10% working. An alloy which undergoes greater work hardening at all degrees of working or degrees of strain, i.e. an alloy which undergoes greater strain hardening over the entire strain range, is highly preferable.

Moreover what is particularly desirable is a material which displays a higher strain hardening rate and which displays the higher strain hardening rate over the entire strain range.

The subject application presents a further improvement in the nickel aluminide to which significant increased ductilization has been imparted.

BRIEF SUMMARY OF THE INVENTION

It is accordingly one object of the present invention to provide a method of forming a tri-nickel aluminide base alloy of improved positive temperature dependence of yield strength.

Another object is to provide a rapidly solidified tri-nickel aluminide base alloy of improved work hardening rate.

Another object is to provide a nickel aluminide alloy having preferred levels of boron doping.

Another object is to provide a tri-nickel aluminide having improved positive temperature dependence of yield strength and work hardening rate.

It is another object of the present invention to provide a method of improving the properties of articles adapted to use in structural parts at room temperature as well as at temperatures up to 600° C.

Another object is to provide an article suitable for withstanding significant degrees of stress and for providing appreciable ductility at room temperature as well as at temperatures up to 600° C.

Another object is to provide a consolidated material which can be formed into useful parts having the combination of properties of significant strength and ductility at room temperature and at temperatures up to 600° C.

Another object is to provide a consolidated material which has a combination of strength and ductility at all temperatures which was not heretofore attainable.

Another object is to provide parts consolidated from powder which have a set of properties useful in applications such as jet engines and which may be subjected to a variety of forms of stress.

Other objects will be in part apparent and in part set forth in the description which follows.

In one of its broader aspects an object of the present invention may be achieved by providing a melt having a tri-nickel aluminide base, containing a relatively small percentage of boron and containing four other different alloying materials. The composition of the melt is as follows in atomic percent: nickel 64–68%; cobalt 8–12%; aluminum 16–20%; silicon 4–6%; niobium 0.26–0.30%; zirconium 0.02–0.04%; and boron 0.2–0.7%.

The melt is then atomized by inert gas atomization. The melt is rapidly solidified to powder during the atomization. The atomized powder material is then consolidated by hot isostatic pressing at a temperature of about 1150° C. and at about 15 ksi for about two hours. The isostatically pressed sample is cold rolled to impart a set of significantly improved properties to the sample.

Although the melt referred to above should ideally consist only of the atoms of the intermetallic phase and substituents as well as atoms of boron, it is recognized that occasionally and inevitably other atoms of one or more incidental impurity atoms may be present in the melt.

As used herein the expression tri-nickel aluminide base composition refers to a tri-nickel aluminide which contains impurities which are conventionally found in nickel aluminide compositions. It may include as well in addition to the combination of alloying elements prescribed below other constituents and/or substituents which do not detract from the unique set of favorable properties which are achieved through practice of the present invention.

BRIEF DESCRIPTION OF THE DRAWINGS

The invention will be made clearer from the description which follows by reference to the accompanying drawings in which.

DETAILED DESCRIPTION OF THE INVENTION

Figure 1:
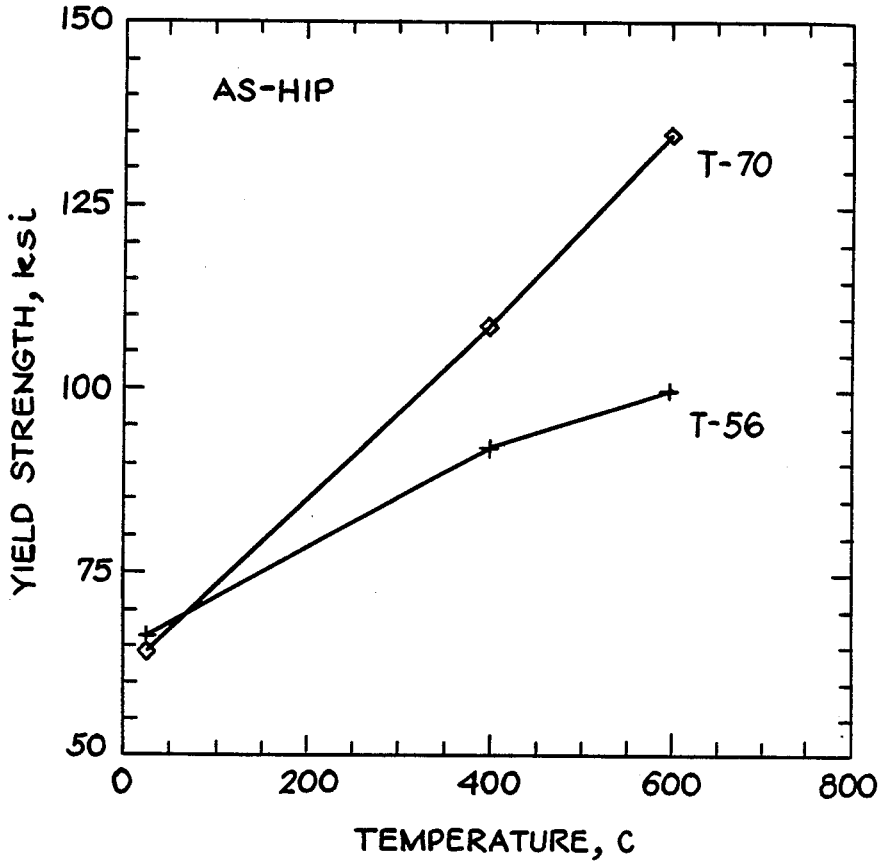
FIG. 1 is a graph in which yield strength in ksi is plotted against the temperature in degrees centigrade.

This invention involves combinations of constituent and substituent metals in an alloy system.

By a substituent metal is meant a metal which takes the place of and in this way is substituted for another and different ingredient metal, where the other ingredient metal is part of a desirable combination of ingredient metals which ingredient metals form the essential constituent of an alloy system.

For example, in the case of the superalloy system $Ni_3Al$ or the tri-nickel aluminide base superalloy, the ingredient or constituent metals are nickel and aluminum. The metals are present in the stoichiometric atomic ratio of approximately 3 nickel atoms for each aluminum atom in this system.

Substituent metals are metals which are substituted for and take the place of constituent metals in the superalloy crystal structure. Alloying additives may or may not be substituents in this sense.

The alloys of this invention are essentially single phase alloys and have essentially $\gamma'$ crystal structures. The substituent metals should enter and become part of the single phase alloy and of the $\gamma'$ crystal structure.

Nickel aluminide is found in the nickel-aluminum binary system and as the gamma prime phase of conventional gamma/gamma prime nickel-base superalloys. Nickel aluminide has high hardness and is stable and resistant to oxidation and corrosion at elevated temperatures which makes it attractive as a potential structural material.

Nickel aluminide, which has a face centered cubic (FCC) crystal structure of the $Cu_3A1$ type ($L1_2$ in the Stukturbericht designation which is the designation used herein and in the appended claims) with a lattice parameter $a_o=3.589$ at 75 at. % Ni and melts in the range of from about 1385° to 1395° C., is formed from aluminum and nickel which have melting points of 660° and 1453° C., respectively. Although frequently referred to as $Ni_3Al$, tri-nickel aluminide is an intermetallic phase and not a compound as it exists over a range of compositions as a function of temperature, e.g., about 72.5 to 77 at. % Ni (85.1 to 87.8 wt.%) at 600° C.

Polycrystalline $Ni_3Al$ is quite brittle and shatters under stress as applied in efforts to form the material into useful objects or to use such an article.

It was discovered that the inclusion of boron in the rapidly cooled and solidified alloy system can impart desirable ductility to the rapidly solidified alloy as taught in U.S. Pat. No. 4,478,791.

It has been discovered that certain metals can be beneficially substituted in part for the constituent metal nickel. This substituted metal is designated and known herein as a substituent metal, i.e. as a nickel substituent in the $Ni_3Al$ structure or as an aluminum substituent. The beneficial incorporation of substituent metals in tri-nickel aluminide to form tri-nickel aluminide base compositions is disclosed and described in the copending applications referenced above.

Moreover, it has been discovered that valuable and beneficial properties are imparted to the rapidly solidified compositions which have the stoichiometric proportions but which have a substituent cobalt metal as a quaternary ingredient of such a rapidly solidified alloy system. This discovery is described in copending application Ser. No. 647,326 filed Sept. 9, 1984 and assigned to the same assignee as the subject application. This application is referenced above and has been incorporated herein by reference.

The alloy compositions of the prior and also of the present invention must also contain boron as a tertiary ingredient as taught herein and as taught in U.S. Pat. No. 4,478,791. A preferred range for the boron tertiary additive is set out in the patent between 0.5 and 1.5 atomic %.

By the prior teaching of U.S. Pat. No. 4,478,791, it was found that the optimum boron addition was in the range of 1 atomic percent and permitted a yield strength value at room temperature of about 100 ksi to be achieved for the rapidly solidified product. The fracture strain of such a product was about 10% at room temperature.

The composition which is formed must have a preselected intermetallic phase having a crystal structure of the $L1_2$ type and must have been formed by cooling a melt at a cooling rate of at least about $10^3$° C. per second to form a solid body the principal phase of which is of the $L1_2$ type crystal structure in either its ordered or disordered state.

The alloys prepared according to the teaching of U.S. Pat. No. 4,478,791 as rapidly solidified cast ribbons have been found to have a highly desirable combination of strength and ductility. The ductility achieved is particularly significant in comparison to the zero level of ductility of previous samples.

However, it was found that annealing of the cast ribbons led to a loss of ductility. An annealing embrittlement was observed. It is described in copending application Ser. No. 783,718, filed Oct. 3, 1985 (Attorney docket RD-16179). Such annealing embrittlement leads to a low temperature brittleness.

A significant advance in overcoming the annealing embrittlement is achieved by preparing a specimen of tri-nickel aluminide base alloy through a combination of atomization and consolidation techniques. This is also described in the copending application Ser. No. 783,718, filed Oct. 3, 1985 (Attorney docket RD-16179).

It has also been discovered that the problem of annealing embrittlement can be overcome through thermomechanical processing steps. This is described in copending application Ser. No. 783,581, filed Oct. 3, 1985 (Attorney Docket Rd-16105) now U.S. Pat. No. 4,613,480. The texts of these respective copending applications are incorporated herein by reference.

A composition as provided pursuant to this invention has the following approximate composition:

| Ingredient | Concentration in Atomic % |
|---|---|
| Ni | balance |
| Co | 8–12 |
| Al | 16–20 |
| Si | 4–6 |
| Nb | 0.26–0.30 |
| Zr | 0.02–0.04 |
| B | 0.2–0.7 |

Pursuant to the invention the melt is atomized in an inert gas to form rapidly solidified particles of $L1_2$ type structure.

The powder is consolidated to a dense form of novel and improved properties.

The consolidation may be by pressing with a pressure of at least 15 ksi at a temperature of at least 1000° C. for a period of at least one hour.

This invention is directly associated with the enhancement of the combination of properties exhibited by the novel composition, when suitably processed, as follows:

1. positive temperature dependence of yield strength, and
2. high work hardening rate.

While Applicants do not wish to be bound by the accuracy of their concept the composition of the present invention is conceived to be one in which cobalt atoms substitute in nickel sites in the $L1_2$ crystal. Also the alloying atoms silicon, niobium and zirconium are conceived as substituted in the aluminum sites of the ordered intermetallic $Ni_3Al$.

Further the ratio of nickel and its substituents to aluminum and its substituents is targeted to be 76:24 and the boron is preferably about 0.24 atomic percent.

The ingredients for such a composition are vacuum induction melted to form an ingot of the desired composition. The ingot is then transferred to a gas atomization apparatus where it is remelted and atomized with argon gas into powder.

As a control, a batch of $Ni_3Al$-B alloy powder is prepared without any substituent metals as sample T-56 by the same steps of the same method and tested as described below.

In the description of the invention the inventive concept will be made clearer by reference to the following examples.

EXAMPLE 1

A set of tri-nickel aluminide base alloys were each individually vacuum induction melted to form a ten pound heat. The compositions of the alloys are listed in Table I below.

TABLE I

| Alloy | Ni | Co | Al | Si | Nb | Zr | B |
|---|---|---|---|---|---|---|---|
| T-56 | balance | — | 23.82 | — | — | — | 0.75 |
| T-70 | balance | 10.01 | 18.54 | 5.02 | 0.28 | 0.03 | 0.24 |

The ingots formed from the vacuum melting were remelted and were then atomized in argon. The atomization was carried out in accordance with one or more of the conventional atomization processes which may be employed to form rapidly solidified powder to be consolidated. The powder produced was screened and the fraction having particle sizes of −100 mesh or smaller were selected.

The selected powder was sealed into a metal container and HIPped. The HIP process is a hot-isostatic-pressing process. In this example, the selected powder specimens were HIPped at about 1150° C. and at about 15 ksi for a period of about 2 hours.

Most mechanical properties of the consolidated specimens were evaluated in the as-HIP condition. The room temperature results are set forth in Table II below.

TABLE II

| Room Temperature Property as HIPped | | |
|---|---|---|
| Alloy | T-56 | T-70 |
| Y.S.(ksi) | 66 | 64 |
| T.S.(ksi) | 193 | 208 |
| El.(%) | 45 | 39 |

FIG. 1 shows the yield strength and temperature relationship of the as-HIPped samples T-70 and T-56. In FIG. 1 yield strength in ksi is plotted as ordinate against temperture in degrees centigrade as abscissa. As is evident from the figure both alloys exhibit positive temperature dependence of their yield strength. However as is also evident from the FIG. 1 the alloy T-70 demonstrates a much larger increase in its flow strength with temperature than the alloy of composition T-56.

As is also evident from the FIG. 1 both alloys have about the same flow strength at room temperature. At room temperature the flow strength of each is approximately 65 ksi.

The T-70 test specimen has a more rapid rate of increase of yield strength with increasing temperature than the T-56 test specimen. This differential rate of increase is also evident from FIG. 1.

At about 600° C. the yield strength increment of as-HIPped T-70 specimen (between room temperature and 600° C.) is more than twice as great as that of the T-56 specimen. T-70 shows an increment of 71 ksi over this range and this increment is more than twice that of the 34 ksi increment displayed by the T-56 specimen.

The compositions of the present invention display a high work hardening rate. The advantage of the high work hardening rate is that it makes it possible to effectively strengthen an intermetallic $Ni_3Al$-B composition through a relatively small amount of deformation.

Figure 2:
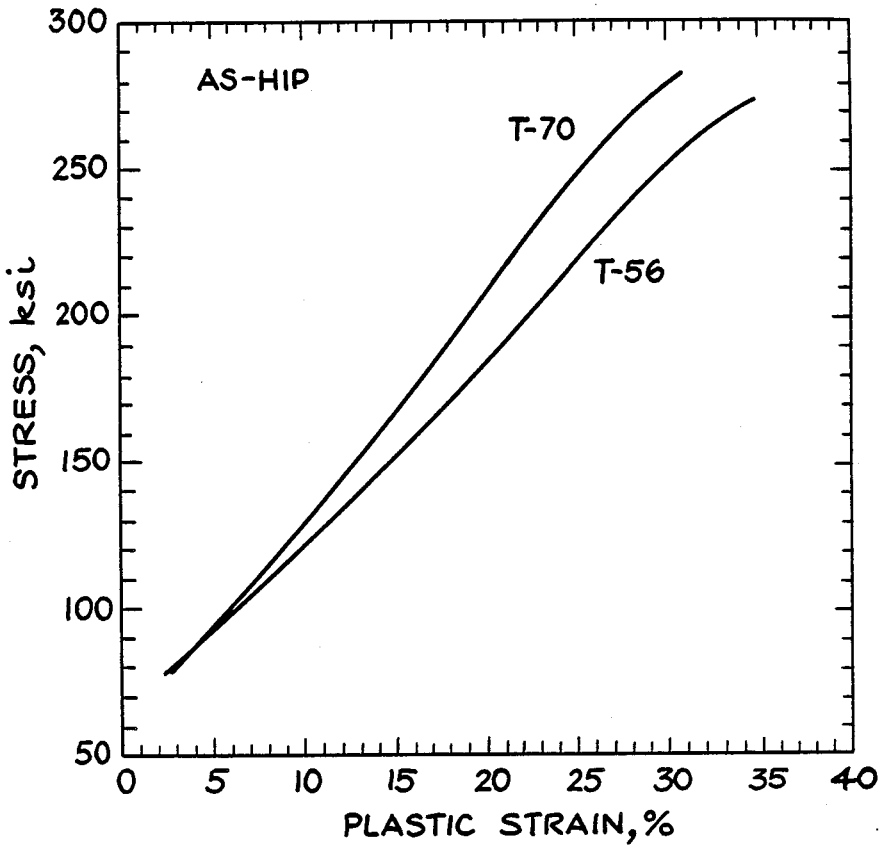
FIG. 2 is another graph in which stress in ksi is plotted against plastic strain in percent.

The important relationship is plotted in FIG. 2. In FIG. 2 room temperature true stress in ksi is plotted as an ordinate against plastic strain in percent as abscissa. From the plots made for the separate specimens T-56 and T-70 it is seen that for any strain there is an increment between the corresponding stress for the specimen T-70 as compared to specimen T-56. The T-70 specimen always develops a higher stress than the T-56 specimen for any given strain.

The strain hardening rate, dS/de, corresponds to the slope of the true stress-strain curve of FIG. 2. The higher slope of the curve for specimen T-70 reflects the higher alloy hardening rate and the improved ability to be work hardened by cold work.

Figure 3:
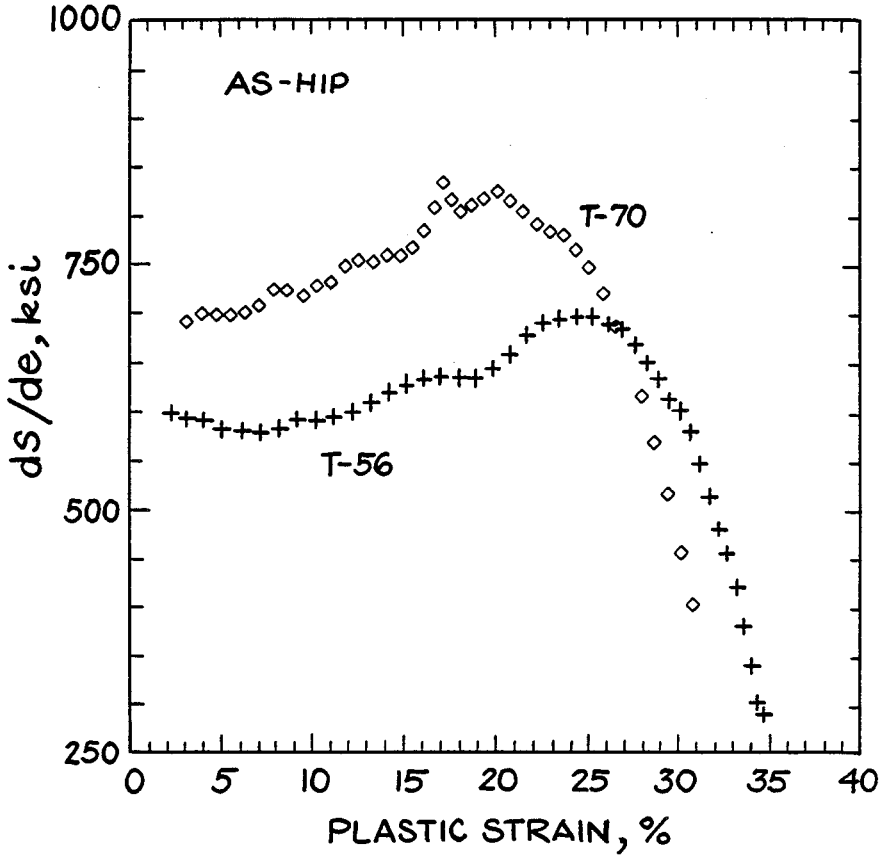
FIG. 3 is a different graph in which the strain hardening rate dS/de in ksi is plotted against plastic strain in percent.

This same relationship of the superior work hardening ability of the T-70 specimen is also evident from the data plotted in FIG. 3. FIG. 3 is a graph of the strain hardening rate, dS/de, plotted as ordinate against plastic strain in percent as abscissa. From this graph it is evident that in spite of slight variations of dS/de at different strains, the T-70 specimen exhibits a strain hardening rate at least 100 ksi higher than that of specimen T-56 for the entire strain range until the rapid drop of dS/de occurs at the point approaching to plastic instability.

The tensile properties of the composition of cold worked specimen T-70 were tested and evaluated at room temperature and at 600° C. The results of the tests conducted are listed in Table II.

TABLE II

| T-70 alloy strengths developed by cold working | | |
|---|---|---|
| | Y.S.(ksi) | T.S.(ksi) |
| Room Temp.: | | |
| As-HIP | 64 | 208 |
| Cold Press(20%) | 228 | 248 |
| Cold Roll(25%) | 250 | 263 |
| 600C: | | |
| As-HIP | 135 | 150 |
| Cold Press(20%) | 160 | 189 |
| Cold Roll(25%) | 178 | 207 |

From the test results presented in Table II, it is evident that with a 20% to 25% plastic deformation the alloy of this invention develops an ultra-high strength level.

From Table II it is also evident that the major portion of the useful high strength of compositions of the present invention is maintained at a temperature up to about 600° C.

What is claimed and sought to be protected by Letters Patent of the United States is as follows:

1. A tri-nickel aluminide with the following approximate alloy content:

| Ingredient | Atomic Percent |
|---|---|
| Ni | balance |
| Co | 8–12 |
| Al | 16–20 |
| Si | 4–6 |
| Nb | 0.26–0.30 |
| Zr | 0.02–0.04 |
| B | 0.2–0.7 |

said alloy being rapidly solidified and having a $L1_2$ crystal structure and being predominantly single phase.

2. The alloy of claim 1 in the form of a fine powder.

3. The alloy of claim 1 is in a form consolidated from fine powder.

4. The alloy of claim 3 wherein the consolidation is at about 1000° to 1200° C. for a time of more than one hour.

5. The alloy of claim 3 in which the consolidated form is work hardened.

6. The alloy of claim 3 in which the consolidated form is work hardened by greater than about 20%.

7. A composition with improved work hardening properties which comprises a rapidly solidified boron doped tri-nickel aluminide having a $L1_2$ type crystal structure having substituents in place of a portion of the nickel and in place of a portion of the aluminum as follows:

| Ingredient | Approximate Atomic Concentration |
|---|---|
| Nickel | balance |
| Cobalt | 10.01 |
| Aluminum | 18.54 |
| Silicon | 5.02 |
| Niobium | 0.28 |
| Zirconium | 0.03 |

-continued

| Ingredient | Approximate Atomic Concentration |
|---|---|
| Boron | 0.24. |

8. The composition of claim 7 rapidly solidified in powder form.

9. The composition of claim 7 consolidated from the as cast form by high temperature isostatic pressing at about 15 ksi for at least 1 hour at about 1000° to 1200° C.

10. The composition of claim 9 work hardened by straining.

11. The composition of claim 9 work hardened by straining greater than about 20% and having a strength of over 200 ksi.

12. The method of preparing a tri-nickel aluminide base alloy having a high rate of work hardening which comprises, preparing an alloy of the following composition

| Ingredient | Atomic Percent |
|---|---|
| Ni | balance |
| Co | 8–12 |
| Al | 16–20 |
| Si | 4–6 |
| Nb | 0.26–0.30 |
| Zr | 0.02–0.04 |
| B | 0.2–0.7 |

preparing a melt of the alloy, atomizing the alloy to form rapidly solidified powder, and consolidating the powder to a solid object.

13. The method of claim 7 in which the strength of the object is improved by cold working.

14. The method of claim 8 in which the working is cold pressing.

15. The method of claim 8 in which the working is cold rolling.

16. The method of claim 7 in which the consolidation of the powder is accomplished above 15 ksi and above 1000° C.

17. The method of claim 7 in which the consolidation is accomplished above 15 ksi and above 1000° C. for at least one hour.

18. The method of preparing an aluminum nitride base alloy having a high rate of work hardening which comprises preparing an alloy melt according to the following approximate concentrations:

| Ingredient | Approximate Concentration in atom percent |
|---|---|
| Nickel | balance |
| Cobalt | 10.01 |
| Aluminum | 18.54 |
| Silicon | 5.02 |
| Niobium | 0.28 |
| Zirconium | 0.03 |
| Boron | 0.24 |

rapidly solidifying the melt to a powder by gas atomization, consolidating the powder to body by hot isostatic pressing.

19. The method of claim 18 in which the consolidated powder has a yield strength of greater than about 135 ksi at about 600° C.

20. The method of claim 18 in which the consolidated powder exhibits a strength of over 200 ksi after cold work at least 20%.

* * * * *